US005383288A

United States Patent [19]

Ilmarinen

[11] Patent Number: 5,383,288

[45] Date of Patent: Jan. 24, 1995

[54] METHOD AND DEVICE FOR DRYING PAPER

[75] Inventor: Antti Ilmarinen, Jyväskylä , Finland

[73] Assignee: Valmet Paper Machinery Inc., Helsinki, Finland

[21] Appl. No.: 25,191

[22] Filed: Mar. 2, 1993

[30] Foreign Application Priority Data

Mar. 2, 1992 [FI] Finland ..... 920942

[51] Int. Cl.[6] ..... F26B 7/00

[52] U.S. Cl. ..... 34/392; 34/394; 34/123; 34/124; 34/119

[58] Field of Search ..... 34/12, 114, 115, 116, 34/117, 119, 120, 122, 123, 124, 62, 13, 125, 160, 407, 391, 392, 393, 394, 395, 413, 414, 428; 165/89, 90

[56] References Cited

U.S. PATENT DOCUMENTS 3,377,056 4/1968 Boye ..... 34/160
3,891,500 6/1975 Kankaanpää ..... 34/123
4,194,947 3/1980 Huostila et al. ..... 34/123
4,461,095 7/1984 Lehtinen ..... 34/124
4,622,758 11/1986 Lehtinen et al. ..... 34/13

*Primary Examiner*—Denise L. Gromada
*Attorney, Agent, or Firm*—Steinberg, Raskin & Davidson

[57] ABSTRACT

A method and device in the drying of paper, especially of fine paper or newsprint is disclosed. A paper web to be dried is passed over a mantle face of a large-diameter flow-through cylinder. On the flow-through cylinder, a set of drying-gas jets is applied to the free outer face of the web through a nozzle arrangement. Water is evaporated outward from the outer part of the web by means of the set of drying-gas jets. The water vapor thus evaporated is removed through spaces in the blowing-on hood. By means of the set of drying-gas jets, the interior of the web to be dried is also heated. The mantle face of the flow-through cylinder is cooled by means of a medium flow. Water that has been vaporized out of the web and that has been condensed onto the cooled faces is sucked by means of negative pressure present in the interior of the flow-through cylinder.

24 Claims, 3 Drawing Sheets

METHOD AND DEVICE FOR DRYING PAPER

BACKGROUND OF THE INVENTION

The invention relates to a method for drying a paper web, especially fine paper or newsprint, in a paper machine wherein the paper web to be dried is passed over a mantle face of a large-diameter flow-through cylinder on which a set of drying-gas jets is applied to a free outer face of the web through a nozzle arrangement. Water is evaporated outward from the outer part of the web by means of the set of drying-gas jets. The water vapor thus evaporated is removed through spaces in a blowing-on hood. By means of the set of drying-gas jets, the interior of the web to be dried is also heated.

Further, the invention also relates to a dryer for paper, in particular for fine paper or newsprint, intended for carrying out a method of the invention. The dryer of the present invention comprises a flow-through cylinder and a blowing-on hood arranged above the cylinder. The hood is provided with a nozzle arrangement by means of which a set of drying gas jets can be applied to the outer face of the paper web to be dried while the paper web is being passed over the flow-through cylinder.

In prior art devices, paper, such as newsprint and fine paper, is dried in a multi-cylinder dryer, which comprises a large number of drying cylinders arranged in one row, or in two rows placed one above the other. In the drying operation of tissue paper, in prior art devices, so-called Yankee dryers are utilized. These Yankee dryers comprise a large-diameter heated cylinder on which a so-called blowing-on hood might be arranged. Inside this hood, a large number of nozzle pipes are arranged. Drying air jets are applied through these pipes to the free web face at a high velocity. The mantle of a Yankee cylinder is preferably solid and unperforated, and it is usually a steam-heated pressure vessel. In a conventional blowing-on hood, evaporation of the water in the web takes place in one direction because the water cannot be evaporated towards the smooth face of the Yankee cylinder.

The water evaporation capacity of a prior art cylinder dryer per unit of area of cylinder face is about 15 to about 30 kg/h/sq.m. The corresponding evaporation capacity of a Yankee dryer provided with a blowing-on hood is about 100 to about 150 kg/h/sq.m.

Some drawbacks of prior art multi-cylinder dryers include the high cost of the construction of the dryer and above all the abundant and enormous space required by the dryer in the machine direction. Another drawback is the literally complicated draw of the web through the dryer which is susceptible to disturbances.

OBJECTS AND SUMMARY OF THE INVENTION

An object of the present invention is to provide a new and improved dryer for paper, in particular for fine paper or newsprint, by whose means higher drying capacities are obtained. Such higher drying capacities are necessary, for example, with the constantly increasing running speeds of paper machines.

Another object of the present invention is to increase the drying efficiency of paper dryers by means of a novel solution so that the space occupied by the dryer section in the machine direction can be reduced substantially even to one half of the length of prior art devices. In this case, the investment costs of the paper machine are reduced decisively both in respect of the buildings needed for the machine and in respect of the machinery.

It is a further object of the invention to provide a method and a dryer in which detrimental transverse drying-shrinkage of the web can be controlled more economically and efficiently than in prior art devices.

It is yet another object of the invention to provide a method and a dryer in which the efficiency of the utilization of the drying energy is improved.

In view of achieving these objects stated above and others, in the method of the present invention, the mantle face of the flow-through cylinder is cooled by means of a medium flow. Water that has been vaporized out of the web and condensed onto the cooled faces is sucked by means of negative pressure present in the interior of the flow-through cylinder.

In the device in accordance with the invention, the mantle of the flow-through cylinder is provided with a system of ducts, into which a cooling medium can be passed from a source of cooling medium. The mantle of the flow-through cylinder is provided with through perforations. The mantle has an outer mantle having ducts or capillaries which open into the outer parts of the perforations of the mantle. A drying fabric is passed onto the outer face of the outer mantle. Alternatively, an equivalent wire sock that constitutes a coating on the cylinder is applied to the outer mantle and functions in a similar manner as the drying fabric.

In the method of the invention, hot drying-gas jets are applied from the blowing-on hood to the outer face of the web in order to vaporize water from the outer parts of the web. At the same time, the hot drying-gas jets heat the inner parts of the web. The inner parts of the web contact the cooled faces causing the water vapor evaporated from the web to be condensed. By the effect of suction present in the interior of the flow-through cylinder, the water vapor is carried into the interior of the cylinder, from where it is removed by means of a suction pump.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
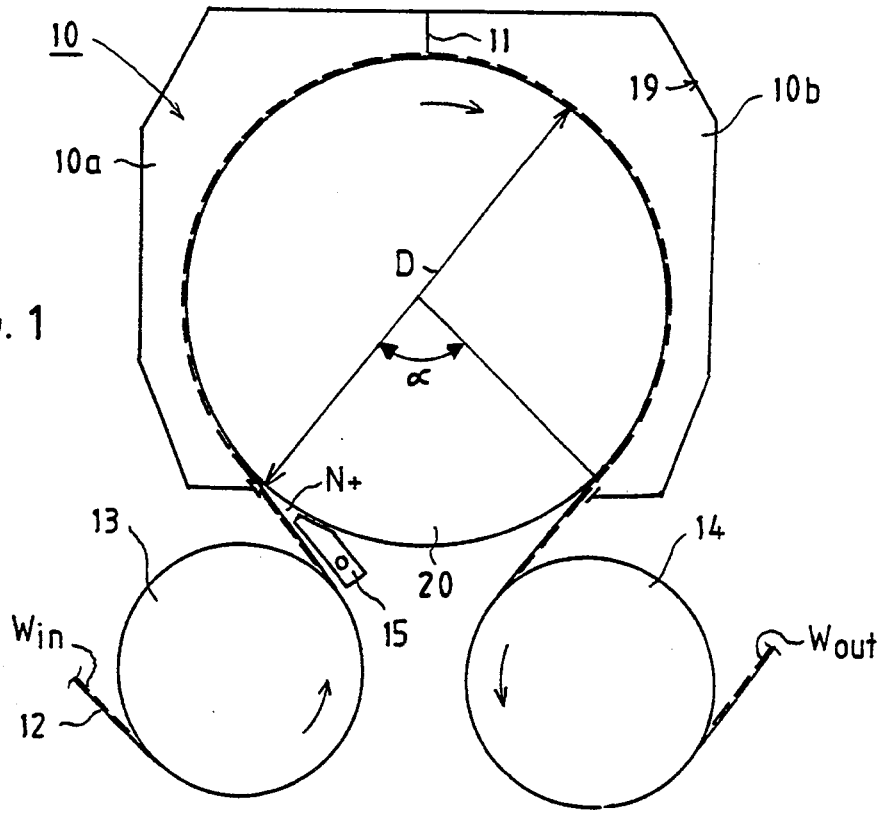
FIG. 1 is a schematic side view of a first embodiment of the present invention used in the method in accordance with the invention.
Figure 2:
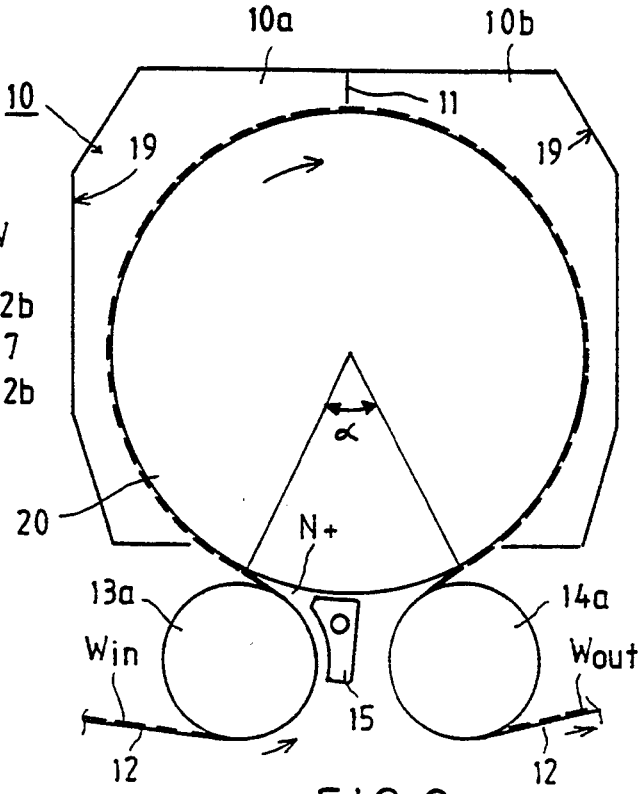
FIG. 2 is a schematic side view of a second embodiment of the device in accordance with the present invention and used in the method in accordance with the invention.

Referring to FIGS. 1 and 2, a dryer for paper, in particular for newsprint and fine paper, in accordance with the present invention is illustrated. The dryer comprises a large-diameter flow-through cylinder 20 having a diameter D which is, as a rule, generally in the range of about 2 m to about 5 m, preferably D is about 3.5 m. Cylinder 20 is enclosed by a blowing-on hood 10 which covers the cylinder 20 over a sector 360°-α, whose magnitude is from about 260° to about 320°. In this case, the sector of the cylinder 20 that remains free from the hood 10 and from the web W to be dried (α) is from about 40° to about 100°.

The blowing-on hood 10 is divided by a transverse partition wall 11 into two compartments 10*a* and 10*b*. It is possible to apply the same or different drying parameters in each of the compartments.

According to FIG. 1, the web $W_{in}$, to be dried is passed on a relatively permeable drying fabric 12 over a first steam-heated drying cylinder 13, on which at least pre-heating and possibly also pre-drying of the web W is performed. After this stage, the web W is transferred on a straight run of the fabric 12 onto the cylinder 20. A positive pressure tends to be induced into an inlet nip N+ defined between the fabric 12 and a mantle 23 of the cylinder 20. This positive pressure attempts to separate the web W from the fabric 12 and is therefore counteracted by means of a blow box 15. By means of the blow box 15, air is ejected out of the inlet nip N+, thereby attempting to bring the nip to a normal pressure or to a slightly negative pressure. This prevents separation of the web W from the fabric 12 in the area of the nip N+.

According to FIGS. 1 and 2, the web W runs on the sector 360°-α around the cylinder 20 and leaves the cylinder and the interior of the hood 10 at the end of the sector. The web W then passes on a straight run of the fabric 12 onto a second drying cylinder 14, on which the web W is after-dried, i.e. heated after it passes through the hood 10. The dried web $W_{out}$ is transferred further to be reeled in a reeling operation. In some embodiments, it is possible to use two through-dryers in accordance with the invention whereby the dryers are placed one after the other. The dryers are preferably arranged to operate so that the web sides are reversed in the latter drying stage. In addition, between the different drying stages, it is preferable to employ a closed draw in order to ensure a sufficiently high web speed.

The dryer shown in FIG. 2 is in some respects similar to that shown in FIG. 1. However, in the embodiment illustrated in FIG. 2, the web $W_{in}$ is passed on the fabric 12 around a first paper guide roll 13*a* onto the cylinder 20 and removed from the cylinder on a second paper guide roll 14*a*. Thus, heated drying cylinders are not employed in this embodiment. In this embodiment, the sector α is also considerably smaller than in FIG. 1.

Figure 3:
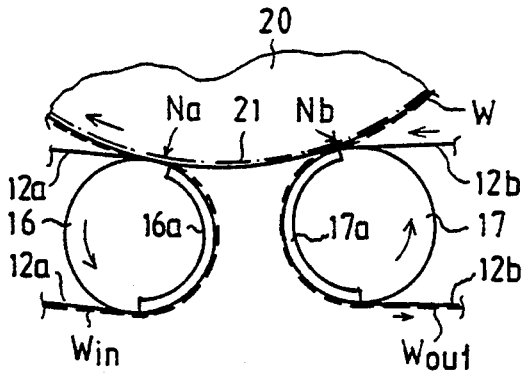
FIG. 3 is an illustration in part of a third embodiment of the device in accordance with the present invention and used in the method in accordance with the invention.

In FIG. 3, the web $W_{in}$ is brought on a first drying fabric 12*a* around a suction sector 16*a* of a suction transfer roll 16. The web W is separated from the first fabric 12*a* in a transfer nip $N_a$ having a slight load. Nip $N_a$ is formed between the cylinder 20 and the suction transfer roll 16. In a corresponding manner, at the rear side of the cylinder 20, the web W is transferred in the transfer nip $N_b$ of a second suction transfer roll 17 onto a second fabric 12*b*. On support of the second fabric 12*b*, the web W is transferred further over a suction zone 17*a* of the second suction-transfer roll 17. Thus, in FIG. 3, the drying fabric 12 that transfers the web W onto the drying cylinder 20 does not run around the cylinder 20. Rather, in this embodiment, the face of the cylinder 20 is coated with a wire-sock loop 21 fixed to the cylinder. The construction and permeability of the sock are similar to properties of the drying fabric 12.

Figure 4:
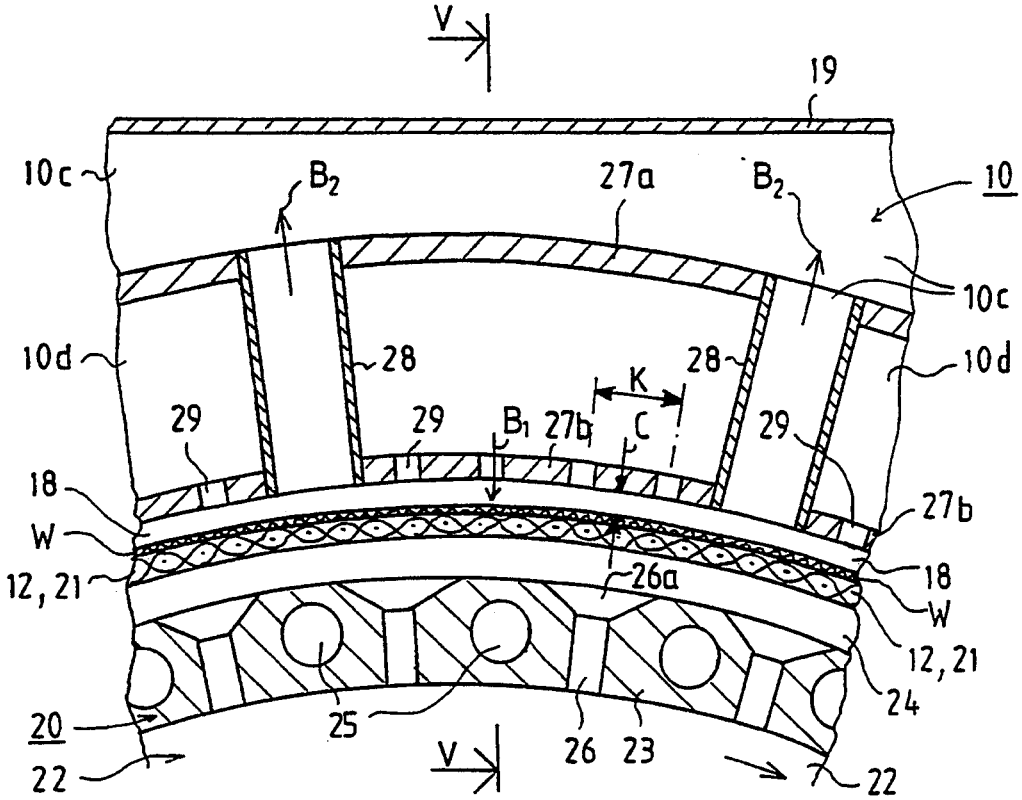
FIG. 4 is a vertical sectional view in the machine direction of a mantle of a Yankee cylinder in accordance with the invention and the mantle of the blowing-on hood of the Yankee cylinder.
Figure 6:
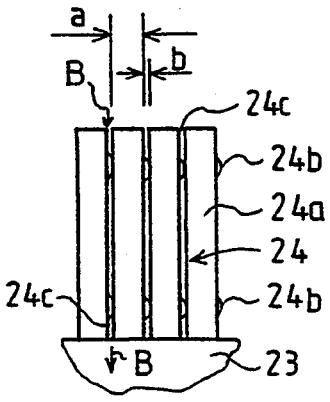
FIG. 6 shows the detail DET encircled in FIG. 5 on an enlarged scale.
Figure 5:
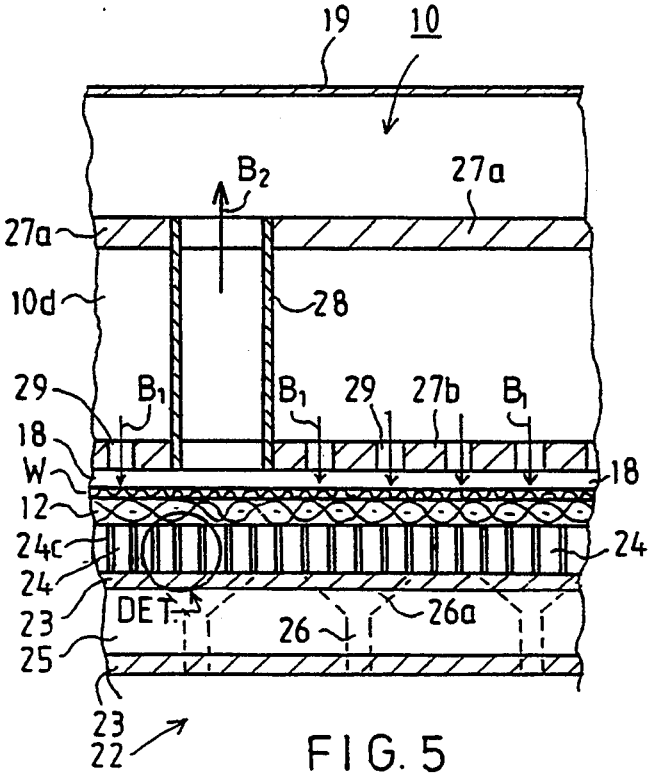
FIG. 5 is a sectional view taken along the line V—V in FIG. 4.

FIGS. 4, 5 and 6 illustrate the construction in accordance with the invention of a drying cylinder and the blowing-on hood 10. The blowing-on hood 10 is provided with outer walls 19 which define exhaust spaces 10*c* in the interior of the hood 10. Inside these spaces 10*c*, there are two walls 27*a* and 27*b* shaped as parts of a circular cylinder. The innermost of the two walls, wall 27*b*, is placed at a distance from the free outer face of the web W such that a small free gap 18 is defined between the wall 27*b* and the web W. In the hood 10, the web W runs on the fabric 12 or on the wire sock 21. The radial dimension φ of the space 18 is generally from about 10 cm to about 50 cm, preferably C is about 25 cm.

A space 10*d* is defined between the partition walls 27*a* and 27*b*. In the inner partition wall 27*b*, a series of nozzle openings 29 are arranged. The diameter φ of the nozzle openings 29 is generally from about 2 mm to about 6 mm, preferably φ is about 4 mm. The sum of all of the open areas formed by the nozzle holes 29, i.e. the percentage of holes, is generally from about 1% to about 6% of the area of the wall 27*b*. The nozzle opening 29 may comprise a set of drying-gas jets. The temperature of the gas in the set of drying-gas jets is arranged in the range of about 250° C. to about 500° C., preferably about 400° C.

A mantle 23 of the flow-through cylinder 20 is provided with axial bores 25 through which a flow of cooling water WA has been arranged. The bores 25 extend over the entire length of the mantle 23. Radial bores, or perforations, 26 are arranged between the bores 25 and have outer orifices with widened portions, or widenings 26*a*. On the outer face of the cylinder mantle 23, a permeable outer mantle 24 is arranged, which, in the embodiment illustrated in FIG. 6, made of a profile band 24*a* by winding. The profile band 24*a* is provided with pin-shaped spacer pieces 24*b* which define gaps 24*c* between the profile-band layers. Through the gaps, a flow of medium can take place through the outer mantle 24 in the direction of arrow B. The spacer pieces 24*b* are, for example, pin-shaped parts having a circular section which are placed on the profile band 24*a* in two rows with suitably small intervals. The gaps 24*c* between the profile bands 24*a* are opened into widenings 26*a* in the radial bores 26. Thus, the mantle 23 and its outer part 24 are permeable and able to convey water into an interior space 22 of the cylinder 20.

In another embodiment, instead of an Outer mantle 24 made of a profile band 24*a*, it is possible to use a corresponding permeable mantle layer which is made, e.g., of a felt-like or mesh-like material or of a sintered material which is provided with capillaries.

Figure 7:
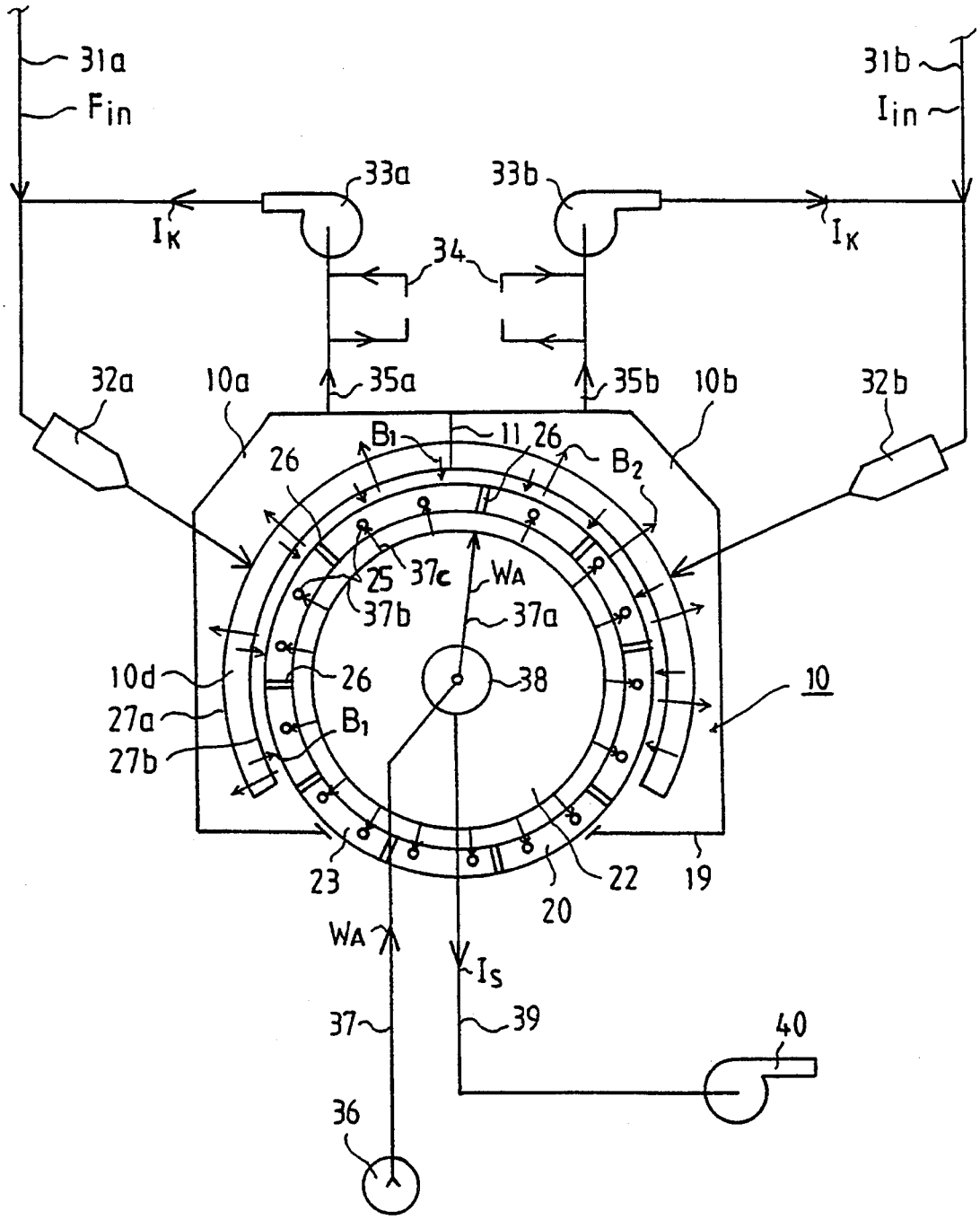
FIG. 7 illustrates the process diagram of another embodiment of the method and the device in accordance with the invention.

FIG. 7 illustrates a preferred embodiment of the drying process. Replacement air is passed along an air duct 31*a* of the first compartment 10*a* of the hood 10 in the direction of the arrow $I_{in}$ to a combustion unit 32*a*. The blowing-on air for the web W is heated in the combustion unit 32*a*, e.g., to about 350° C. Hot air is blown out of the combustion unit 32*a* into a space 10*d* between the walls 27*a* and 27*b*. The hot air is discharged out of the space 10*d* through the nozzle holes 29 as sharp jets in the direction of arrows $B_1$, and at a high velocity ($v \approx 90$ m/s), against the outer face of the web W to be dried. This movement produces a so-called "impingement" drying effect by whose means water vapor is evaporated out of the outer part of the web outward. The water vapors thus evaporated are discharged through spaces 18,28,10c in the flow-through hood 10. By the effect of the drying-gas jets, the water contained in the interior of the web is also vaporized.

Exhaust-air flows are passed into the space 10c from the intermediate space 18 outside the web W, through pipes 28, in the direction of arrows $B_2$. From space 10c, the air flow is passed further through a duct 35a to a heat recovery system 34. From the system 34, the air flow is passed further by means of a blower 33a, as recirculation air $I_k$ to be combined with the replacement air flow $I_{in}$.

A corresponding system operates in the second compartment 10b in the blowing-on hood 10. This compartment is separated by partition walls 11 at spaces 10c and 10d. Compartment 10b also includes a drying-air system similar to that described above and comprising a replacement-air duct 31b, a combustion unit 32b, a recirculation-air duct 35b, a circulation air blower 33b and a heat-recovery system 34.

For cooling the mantle 23 of the cylinder 20, a flow of cooling water WA is passed by means of a cooling-water pump 36 along duct 37 into the cylinder. In the cylinder, the cooling water WA is distributed by means of a pipe duct 37a into a ring pipe 37b and through branch pipes 37c branching from the ring pipe 37b into the axial bores 25 in the cylinder mantle 23. At the opposite ends of the axial bores 25, there are corresponding water draining ducts and exhaust ducts.

Negative pressure is produced in the interior space 22 in the cylinder 20 in the range of about 10 kPa to about 30 kPa. This takes place through a suction duct 38 placed in connection with one of the axle journals of the cylinder 20. The suction duct 38 communicates with a suction duct 39, which communicates with a suction pump 40. Suction pump 40 removes both air and water that has been separated from the web W.

In the following, the drying method carried out by the device described above will be described with reference to FIGS. 1–7. The water vapor evaporated from the interior of the web W is carried through the fabric 12;21 onto the cooled cylinder face 24,23, where the condensed water is sucked into the capillaries or grooves 24c that form the hollow face of the cylinder. The water is further sucked into the widened outer portions 26a of the radial bores 26 by the effect of the negative pressure prevailing in the interior 22 of the cylinder 20. By means of the negative pressure, water is also drained in the area of the cylinder corresponding to angle $\alpha$ not covered by the web W. In this area, the water operates as a "seal" in ducts 26,26a,24c in the mantle 23 in the manner of a water seal. Thus, the use of a relatively high negative pressure in the interior 22 of the cylinder 20 is possible.

The drying takes place so that thermal energy is transferred from the hot air, $B_1$ blown onto the web W, to the wet web W, whereby evaporation of water takes place in the web W. On the outer face of the web W, there is nothing to prevent the evaporated vapor from being carried into the exhaust ducts 18,28,10c. At its inner face, the web W is supported by a mesh-like drying fabric 12;21. When temperature of the fabric 12;21 and of the outer face 23,24 of the cylinder 20 is kept low, the vapor evaporated from the inner face of the web W is condensed as water onto these cold faces. As the faces are maintained at a lower temperature, the temperature of the water vapor condensed on the faces is consequently lower.

It is an advantage of this arrangement that since the vapor evaporated from the inner face of the paper web is condensed to water, the resistance to the flow of water vapor that would be constituted by the fabric 12;21 is avoided. Thus, the drying of the web W can take place efficiently through both faces of the web.

In order that blowing-through should also occur in the case of newsprint with the dry solids contents used in the drying method, the negative pressure in the interior 22 of the cylinder 20 is preferably in the range of about 2 kPa to about 30 kPa, preferably from about 10 kPa to about 20 kPa. At this level of negative pressure, the vaporization temperature of water is about 90° C. Thus, when the temperature of the inner face of the web W is higher than 90° C., the water contained in it is vaporized. On the other hand, when the temperature of the cooled outer face of the cylinder 20 is lower than 90° C., the water vapor tends to be condensed on it.

In the method and dryer in accordance with the invention, there is a pressure difference acting upon the web W throughout the entire process of drying. This pressure difference fixes the web firmly onto the outer face of the fabric 12 or of the corresponding wire sock 21. Hereby, a substantial advantage is obtained that, during the drying process, the web substantially does not shrink in the transverse direction, which has been the case, e.g., in the prior art cylinder dryers. In such prior art devices, this shrinkage has a number of detrimental effects, e.g., on different transverse profiles of the web, such as the profiles of fiber orientation. This problem is eliminated in the present invention in a novel way.

The scope of the invention also includes embodiments of equipment in which there is no fabric 12 or equivalent wire sock 21 employed in the dryer. In such a case, on the cylinder 20, a capillary face 24 is employed as it does not mark the web to a detrimental extent. The face of the web is arranged to enter into direct contact with the capillary face.

The examples provided above are not meant to be exclusive. Many other variations of the present invention would be obvious to those skilled in the art, and are contemplated to be within the scope of the appended claims.

I claim:

1. A method for drying paper, comprising passing a paper web to be dried over a mantle face of a large-diameter flow-through cylinder, applying a set of drying-gas jets onto the web to evaporate water in the web, said jets being applied as the web passes over said mantle face, removing a part of the evaporated water from the web through a blowing-on hood outward away from said mantle face, cooling said mantle face of the flow-through cylinder, providing negative pressure in an interior of said cylinder to draw a remaining part of the evaporated water in the web toward said mantle face such that the remaining part of the evaporated water condenses on said mantle face, and drawing the condensed water from said mantle face through perforations in said mantle face to continuously seal said perforations over the entire circumference of said cylinder and maintain the negative pressure in the interior of said cylinder.

2. The method of claim 1, further comprising providing the negative pressure in the interior of said flow-through cylinder is in the range of about 2 kPa to about 30 kPa, and heating a gas to flow in said set of drying-gas jets to a temperature from about 250° C. to about 500° C.

3. The method of claim 2, wherein the negative pressure in the interior of said flow-through cylinder is in the range of about 10 kPa to about 20 kPa, and the temperature of the gas in said set of drying-gas jets is about 400° C.

4. The method of claim 1, further comprising heating the web before the web is passed to said cylinder by means of a heated drying cylinder.

5. The method of claim 1, further comprising partitioning said blowing-on hood into at least two compartments, arranging said compartments one after the other in a running direction of the web, and providing individual drying parameters in each of said compartments.

6. The method of claim 1, further comprising passing the web over a sector of said cylinder, said sector having a magnitude from about 260° to about 320°.

7. The method of claim 6, wherein said sector has a magnitude of about 270°.

8. A dryer for paper, comprising a flow-through cylinder over which a paper web runs in a running direction, said cylinder comprising an inner mantle and an outer mantle arranged above said inner mantle in a radial direction of said cylinder, said outer mantle having ducts and providing an outer mantle surface of said cylinder, said inner mantle comprising through perforations having outer parts which open into said outer mantle, means for passing a cooling medium through said inner mantle, said means comprising a system of ducts arranged within said inner mantle, a blowing-on hood arranged above said cylinder, said hood comprising a nozzle arrangement by whose means a set of drying-gas jets is applied to an outer face of the paper web to evaporate water in the web, and means for providing negative pressure in an interior of said cylinder to draw a part of the evaporated water toward said mantle surface such that the evaporated water condenses on said mantle surface, the evaporated water being drawn from said mantle surface through said perforations over the entire circumference of said cylinder to continuously seal said perforations and maintain the negative pressure in the interior of said cylinder.

9. The dryer of claim 8, wherein said outer mantle has an outer face on which a drying fabric is passed.

10. The dryer of claim 8, wherein said outer parts of said perforations comprise widened outer orifices which connect to said ducts in said outer mantle such that water removed from the web and present in said ducts in said outer mantle flows to said outer orifices.

11. The dryer of claim 8, wherein said outer mantle is formed of a profile band by winding, said profile band having spacer pieces on at least one of its vertical sides which define said ducts between successive windings of said profile band, said ducts in said inner mantle being connected to said perforations in said mantle such that water removed from the web and present in said ducts flows to said perforations.

12. The dryer of claim 11, wherein said spacer pieces comprise pins and said ducts in said inner mantle are connected to said outer parts of said mantle.

13. The dryer of claim 8, wherein the web is carried on a drying fabric over said cylinder, said fabric carrying the web over a sector of said cylinder whose magnitude is in the range of about 260° to about 320°, and further comprising at least one drying cylinder arranged before said cylinder in the running direction of the web to pre-heat the web.

14. The dryer of claim 8, wherein the web is carried on a drying fabric over said cylinder, said fabric carrying the web over a sector of said cylinder whose magnitude is in the range of about 260° to about 320°, and further comprising a paper guide roll arranged before said cylinder in the running direction of the web.

15. The dryer of claim 8, wherein said cylinder comprises a wire-sock face and the web is carried on a first wire onto said flow-through cylinder, the dryer further comprising a first transfer-suction roll arranged before said cylinder in the running direction of the web and having a suction zone, the web running over said first roll and being transferred from said first roll after said suction zone of said first roll in a first transfer nip onto said wire-sock face, and a second transfer-suction roll arranged after said cylinder in the running direction of the web, said second roll having a suction zone, the web being transferred from said cylinder in a second transfer nip onto a second wire running over said second roll at a beginning of said suction zone of said second roll.

16. The dryer of claim 8, wherein said blowing-on hood comprises at least two compartments arranged one after the other in the running direction of the web, further comprising heating devices, replacement-air ducts running through said heating devices, a first duct connecting to a first one of said at least two compartments and a second duct connecting to a second one of said at least two compartments, and recirculation-air flow means for providing a recirculation-air flow from said first and second compartments, said recirculation-air flow means comprising a heat exchanger, and circulation-air blowers, said recirculation-air flow being passed through said heat exchanger and said circulation-air blowers to flow into said replacement-air ducts.

17. The dryer of claim 16, further comprising a duct arranged in an axle journal of said cylinder, a vacuum pump connecting with said duct, a ring pipe and a cooling-water pipe, said cooling-water pipe being connected to said system of ducts via said ring pipe, and a cooling-water pump connected to said cooling-water pipe for pumping water to said system of ducts.

18. The dryer of claim 8, wherein said set of drying-gas jets are arranged to evaporate water from an outer part of the web and heat an interior of the web such that water in the web is evaporated outward away from said mantle surface, said hood comprising spaces for removing the evaporated water.

19. The dryer of claim 15, wherein said first and second rolls are arranged in proximity to said cylinder such that the web runs over a sector of said cylinder having a magnitude of from about 260° to about 320°.

20. The dryer of claim 8, wherein said outer mantle has a corresponding wire sock applied to said outer face to form a coating on said cylinder.

21. The method of claim 1, further comprising heating the web after the web is passed over said cylinder by means of a heated drying cylinder.

22. The dryer of claim 8, wherein said ducts in said outer mantle comprise capillaries.

23. The dryer of claim 8, wherein the web is carried on a drying fabric over said cylinder, said fabric carrying the web over a sector of said cylinder whose magnitude is in the range of about 260° to about 320°, and further comprising at least one drying cylinder arranged after said cylinder in the running direction of the web to after-heat the web.

24. The dryer of claim 8, wherein the web is carried on a drying fabric over said cylinder, said fabric carrying the web over a sector of said cylinder whose magnitude is in the range of about 260° to about 320°, and further comprising a paper guide roll arranged after said cylinder in the running direction of the web.

* * * * *